US005430272A

United States Patent [19]

Takahashi

[11] Patent Number: 5,430,272

[45] Date of Patent: Jul. 4, 1995

[54] METHOD AND APPARATUS FOR HEATING FOOD

[75] Inventor: Yuki Takahashi, Aichi, Japan

[73] Assignee: Kabushiki Kaisha Toshiba, Kawasaki, Japan

[21] Appl. No.: 108,512

[22] Filed: Aug. 18, 1993

[30] Foreign Application Priority Data

Aug. 31, 1992 [JP] Japan ..... 4-230985

[51] Int. Cl.[6] ..... H05B 1/02; H05B 6/68

[52] U.S. Cl. ..... 219/497; 219/707; 219/506; 219/413; 219/492; 99/325

[58] Field of Search ..... 219/705-709, 219/492, 497, 506, 481, 412, 413; 99/325, 327

[56] References Cited

U.S. PATENT DOCUMENTS

| | | | |
|---|---|---|---|
| 4,171,770 | 10/1979 | Mailander, Sr. | 237/3 |
| 4,378,691 | 4/1983 | Terada et al. . | |
| 4,463,238 | 7/1984 | Tarabe | 219/705 |
| 4,484,065 | 11/1984 | Ueda . | |
| 4,791,263 | 12/1988 | Groeschel, Jr. . | |
| 4,831,225 | 5/1989 | Ishifuro et al. . | |
| 4,894,502 | 1/1990 | Oh . | |
| 4,905,579 | 3/1990 | Dame | 165/909 |
| 5,282,770 | 2/1994 | Shibata | 454/239 |
| 5,319,171 | 6/1994 | Tazawa | 219/705 |

FOREIGN PATENT DOCUMENTS

| | | |
|---|---|---|
| 0078607 | 5/1983 | European Pat. Off. . |
| 57-037633 | 6/1982 | Japan . |
| 58-178129 | 1/1984 | Japan . |
| 61-000526 | 1/1986 | Japan . |
| 2-061426 | 5/1990 | Japan . |
| 2-030412 | 7/1990 | Japan . |
| 2-293534 | 2/1991 | Japan . |
| 3-168530 | 10/1991 | Japan . |

OTHER PUBLICATIONS

Patent Abstracts of Japan, vol. 8, No. 16 (M-270) Jan. 1984, re JP-A-58 178 129.

Patent Abstracts of Japan, vol. 15, No. 407 (M-1169) Oct. 1991, re JP-A-03 168 530.

Patent Abstracts of Japan, vol. 15, No. 65 (M-1082) Feb. 1991, re: JP-A-02 293 534.

Patent Abstracts of Japan, vol. 6, No. 105 (M-136) Jun. 1982, re: JP-A-57 037 633.

Patent Abstracts of Japan, vol. 14, No. 235 (M-975) May 1990, re: JP-A-02 061 426.

*Primary Examiner*—Mark H. Paschall

*Attorney, Agent, or Firm*—Cushman, Darby & Cushman

[57] ABSTRACT

A heating apparatus comprises a microprocessor and an alcohol sensor detecting the amount of the alcohol gas generated from a food item to be cooked in a heating cavity of the heating apparatus. The heating operation of the apparatus and a cleaning operation to expel the air in the heating cavity are controlled by the microprocessor. The cleaning operation is performed after the heating operation in accordance with the amount of the alcohol gas detected by the alcohol sensor.

17 Claims, 7 Drawing Sheets

METHOD AND APPARATUS FOR HEATING FOOD

BACKGROUND OF THE INVENTION

1. Field of the Invention

The present invention relates to a heating method and apparatus for cooking food, and more specifically to an improved heating apparatus employing a microprocessor and an alcohol sensor for controlling the heating operation. The present invention may advantageously be employed as a microwave oven.

2. Description of the Related Art

Recently, a microwave oven has been proposed that includes a microprocessor and an alcohol sensor to control heating more automatically and delicately. The quantity of alcohol gas generated from a food item to be cooked is detected by the alcohol sensor, and heating is controlled by the microprocessor based on the output of the alcohol sensor. For example, the heating time and the kind and amount of food to be cooked is determined from the sensor output. However, when heating operations are repeated in such a microwave oven, the alcohol gas generated from a previously cooked food may remain in the heating cavity, adversely affecting future cooking operations.

With reference to FIG. 12, during the time period A, a first heating operation is performed during which the quantity of alcohol gas detected by the alcohol sensor increases. Then after a time period B, the next heating operation is performed during a time period C. However, the amount of alcohol gas generated from the new food item cannot be detected and the heating operation cannot be performed properly because an amount of alcohol gas corresponding to voltage Vd, generated from the previous heating operation remains in the heating cavity at the beginning of time period C.

Therefore, to properly detect alcohol gas, it is necessary that the air in the heating cavity be alcohol-free at the beginning of a heating operation.

Examined Japanese patent application No. Shou 61-526 published on Jan. 9, 1986 discloses a cooking apparatus wherein air in the heating cavity that is potentially contaminated with alcohol is discharged by a fan disposed in the microwave oven immediately before every heating operation. However, from the time that food is placed in the heating cavity until the cleaning operation is completed, some alcohol gas may be generated by the food if the food contains a great amount of alcohol. In this case, the cleaning operation drives off alcohol gas which ought to be detected by the alcohol sensor. Therefore the true quantity of alcohol gas is not detected and the heating operation cannot be performed properly. Furthermore the cleaning operation is always performed, even when the cleaning operation is not necessary. For example, cleaning is not necessary when very little alcohol gas is left in the heating cavity. In this case, the unnecessary cleaning operation prevents the next heating operation from being performed immediately.

SUMMARY OF THE INVENTION

It is a primary object of the present invention to provide a heating method and apparatus in which an alcohol sensor detects the quantity of alcohol gas generated from food to be cooked, wherein the correct quantity of the alcohol gas can be detected and a heating operation can be properly performed.

To accomplish the foregoing in accordance with the invention, the amount of alcohol gas generated by food to be cooked in a heating apparatus is detected with an alcohol sensor. To remove alcohol gas in a heating cavity of the apparatus, the air within the heating cavity is discharged by a fan operated by a controller. The controller controls the heating operation and the selectivity actuates the fan depending upon the alcohol gas detected by the alcohol sensor. The selective cleansing operation with the fan may be performed after the heating operation in which the alcohol is generated, rather than just prior to the next heating operation.

BRIEF DESCRIPTION OF THE DRAWINGS

The features of the present invention will be apparent from the following drawings, wherein.

DESCRIPTION OF THE PRESENTLY PREFERRED EXEMPLARY EMBODIMENTS

Figure 2:
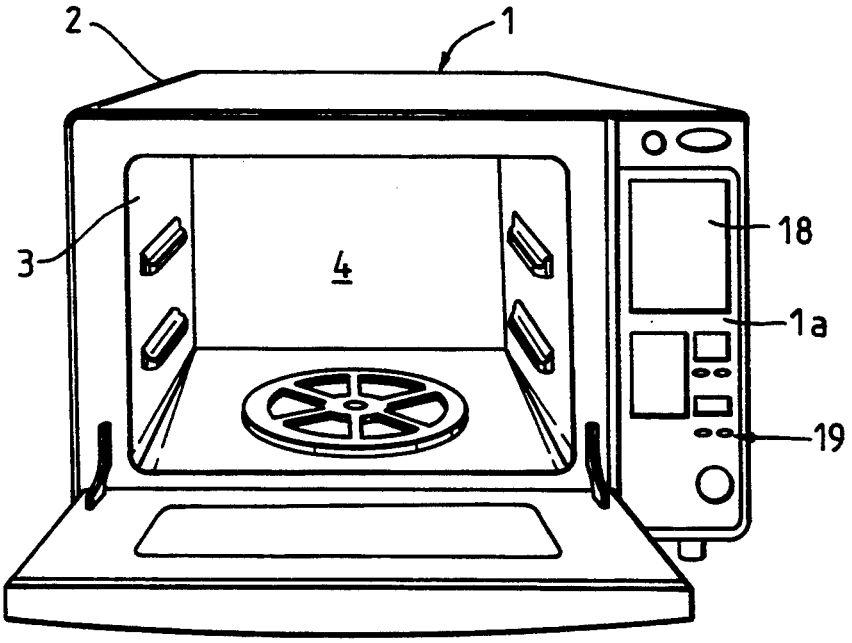
FIG. 2 is a perspective view of the embodiment of the invention.
Figure 3:
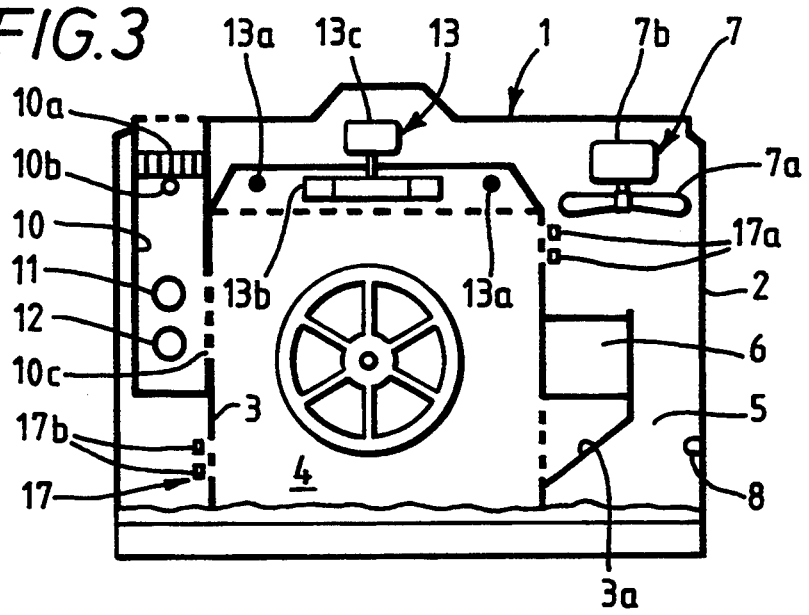
FIG. 3 is a top plan cross-sectional view of the embodiment of the invention.
Figure 4:
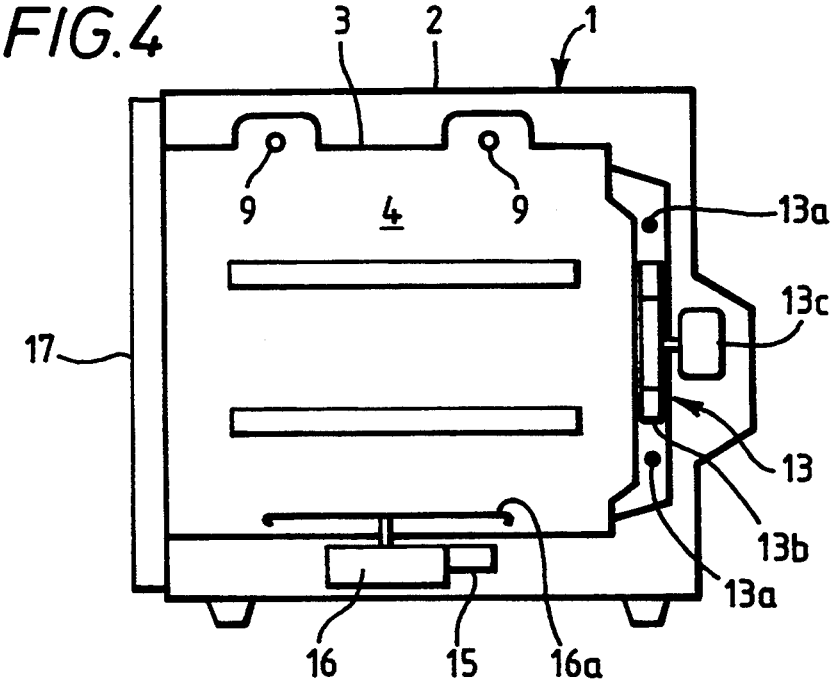
FIG. 4 is a side elevational cross-sectional view of the embodiment of the invention.

With reference to FIGS. 2-4, a main unit 1 has a casing 2 and an inner compartment 3. The interior of the inner compartment 3 is designated as a heating cavity 4. A mechanical chamber 5 is formed between the casing 2 and the inner compartment 3. A magnetron 6, a fan 7 and a temperature sensor 8 are provided in mechanical chamber 5. The fan 7 comprises vanes 7*a* and a fan motor 7*b*, which cools the region of the magnetron 6 during the heating operation and supplies a current of air into the heating cavity 4 through air feed tube 3*a* to purge the air containing alcohol gas after the heating operation. The magnetron 6 supplies microwaves into the heating cavity 4 through a wave guide, not shown.

Resistive heaters 9, used for grilling, are disposed on the inner ceiling of the heating cavity 4. An exhaust passage 10 is formed outside of heating cavity 4 ventable through holes 10*a* formed on the heating cavity 4. A water vapor sensor 11, to detect the quantity of water vapor and an alcohol sensor 12 to detect the quantity of alcohol gas are disposed in the exhaust passage 10. The water vapor sensor 11 and the alcohol sensor 12, respectively, detect the water vapor and the alcohol gas generated from food to be heated in the heating cavity 4. They are constituted such that their output voltages decrease as the detected quantity of water vapor and alcohol gas increase. A deodorizing catalyst 10*a* and a catalyst heater 10*b* are provided in the exhaust passage 10. The heating cavity 4 includes an oven heater 13*a* and a fan 13*b*. The fan 13 comprises vanes 13*b* and an oven fan motor 13*c*.

A turntable motor 15 is disposed outside the bottom of the heating cavity 4 and a weight sensor 16 is disposed beside the turntable motor 15. A light emitting device 17*a* and a light detecting device 17*b* which constitute an optical sensor 17 are disposed on opposite side walls of the heating cavity 4, whereby the presence of any dish or pan arranged in the heating cavity 4 and the height of food to be heated can be determined.

An operating panel la is disposed on the front face of the main unit 1. The operating panel 1*a* comprises a display 18 and switches 19. The switches 19 include a menu selection switch, a heat intensity setting switch, a start switch and so on.

Figure 1:
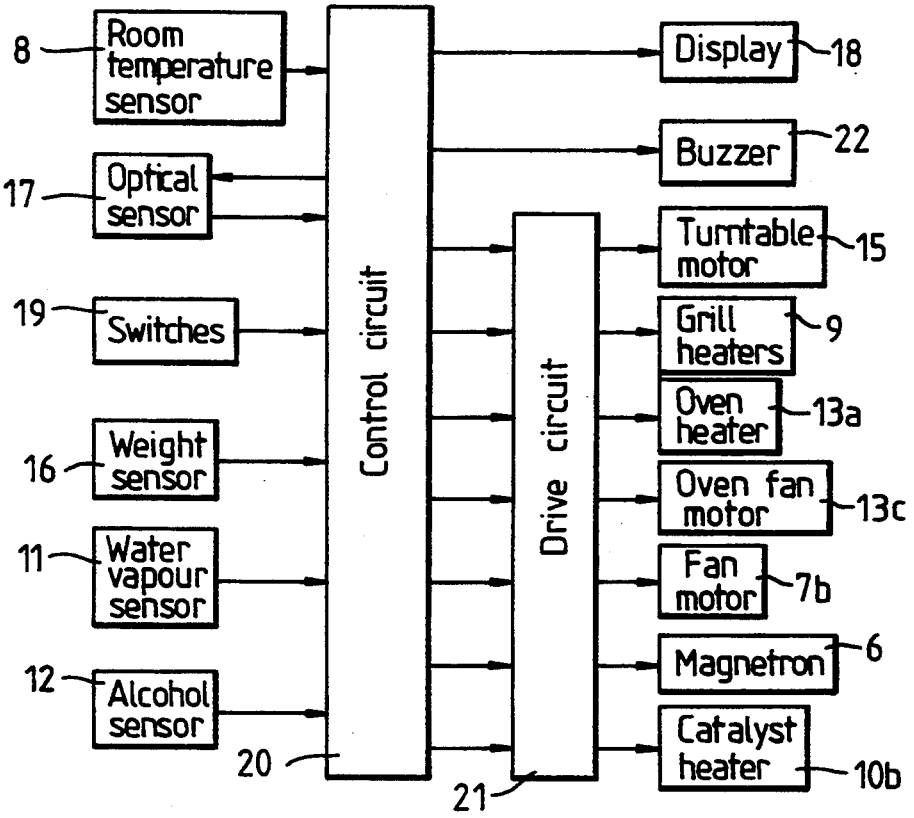
FIG. 1 is a block diagram showing a control circuit configuration of an embodiment of the present invention.

With reference to FIG. 1, the electrical layout of an embodiment of the present invention will be described. A control circuit 20 comprises an A/D converter and a microprocessor. The control circuit 20 controls the magnetron 6, the fan motor 7*b*, the grill heaters 9, the oven heater 13*a*, the oven fan motor 13*c* and the turntable motor 15 through a drive circuit 21 in accordance with an operating program. The operating program controls these components based on the outputs from the switches 19, the optical sensor 17, the weight sensor 16, the water vapor sensor 11 and the alcohol sensor 12. The control circuit 20 also drives and controls the display 18 and a buzzer 22. In this embodiment the control circuit 20 functions as a fractional change calculation means, a decision means and a fan control means.

Figure 5:
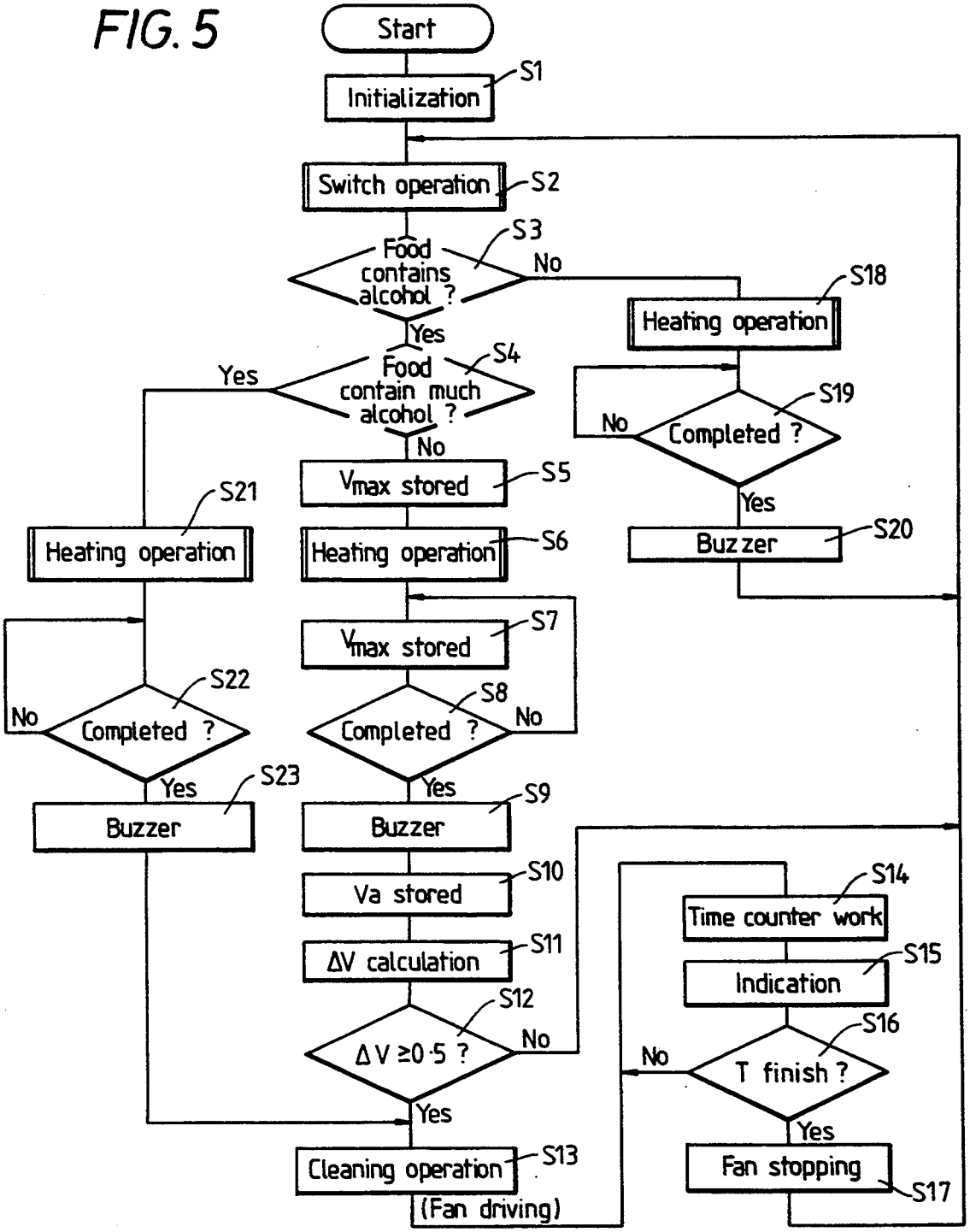
FIG. 5 is a flow chart showing a control program of the heating and cleaning operation of the embodiment of the invention.

Referring to FIG. 5, the operation of the control circuit 20 is shown as a flow-chart. This flow-chart commences with initialization step S1 when a power plug is connected to a power socket. Then an operator selects a desired operation by touching the switches 19 (step S2). In this step, control data in accordance with the operated switches, other than the start switch, is set in the control circuit 20. Then, the flow-chart shifts to the next step S3 when the start switch is touched. In step S3, it is ascertained whether or not the control data set in the step S2 corresponds to food which will release alcohol when cooked (e.g. fish broiling, fruit loaf dough cooking or cake dough cooking). If the food will release alcohol, the flow-chart shifts to step S4. If the food will not release alcohol, the flow-chart shifts to step S18.

In the step S4, it is ascertained whether or not the control data set in the step S2 corresponds to food for which data is previously stored in the control circuit 20 as generating a great amount of alcohol gas. If so, the operation shifts to step S21. If not, the operation shifts to step S5.

In the step S5, the output voltage V of the alcohol sensor 12 is detected and the maximum value Vmax, corresponding to the lowest alcohol content in the heating cavity 4, is stored. Then a heating operation corresponding to the control data set in the step S2 is performed by actuating the magnetron S6 to supply microwave energy (step S6). During the step S6, the fan 7 is actuated to cool the region in which the magnetron 6 is located and the quantity and kind of food disposed in the heating cavity 4 is decided according to the outputs of the alcohol sensor 12 and the other sensors and the heating time is controlled in response. The output voltage V of the alcohol sensor 12, as detected during the step S6, and the maximum value Vmax is stored repeatedly (step S7). Then it is decided whether the heating operation is completed or not (step S8). If it is completed, the magnetron 6 and the fan 7 stop and the buzzer 22 gives a tone indicating the heating operation is completed (step S9) and the output voltage V of the alcohol sensor 12 at this moment is detected and stored as value Va (step S10). Then the percentage change ΔV of the output voltage during the heating operation is calculated (step S11). The percentage change ΔV is calculated as:

$$\Delta V=(Vmax-Va)/Vmax$$

Next, it is decided whether or not the percentage change ΔV is larger than a reference value previously stored in the control circuit 20 (in this embodiment, the reference value is 0.5) (step S12). If the ΔV is larger than 0.5, it is necessary to change the air in the heating cavity 4, i.e. perform a cleaning operation. The fan 7 is driven through the drive circuit 21 to purge the air containing alcohol gas (step S13). During the step S13 a time-counter is actuated (step S14), an indication of cleaning and the remaining time of the cleaning operation is displayed on the display 18 (step S15). At step S16, it is ascertained whether or not the time T previously stored for performing cleaning has elapsed. If so, the fan 7 stops (step S17) and the operation returns to the step S2.

In the step S12, if it is found that the percentage change ΔV is less than 0.5, it is concluded that so little alcohol gas is left in the heating cavity 4 that it is not necessary to purge the air in the heating cavity 4. So the operation shifts to the step S2, skipping step S13 through step S17.

In the step S3, if the control data is for food containing very little alcohol, the operation shifts to step S18. Steps S18 through S20 are performed in a manner similar to steps S6 through S9, except for step S7.

In the step S4, if the control data corresponds to food for which data has been previously stored as containing much alcohol, the operation shifts to the step S21. Steps S21 through S23 are performed identically to steps S18 through S20. Operation then shifts to step S13.

In this embodiment, since the fan 7 purges alcohol-tainted air after the heating operation, no alcohol is left in the heating cavity 4 when the next heating operation is carried out. The quantity of alcohol generated from food cooked during the next heating operation can be accurately detected so that appropriate heating is achieved.

This embodiment determines whether or not the percentage change of alcohol gas generated from food being cooked is larger than the reference value. As a result, the cleaning operation is performed only when alcohol gas is left in the heating cavity 4, i.e. an unnecessary cleaning operation is not performed. Therefore, the next heating operation can be performed immediately if no alcohol gas is left from the previous heating operation.

Furthermore, as determined in the step S4, if the control data set in the step S2 corresponds to food containing a large amount of alcohol, the cleaning operation is performed immediately and reliably after the heating operation.

With reference to FIGS. 6–9, changes in the output voltage V of the alcohol sensor 12 (the quantity of the alcohol gas in the heating cavity 4) of this embodiment are shown for various situations.

Figure 6:
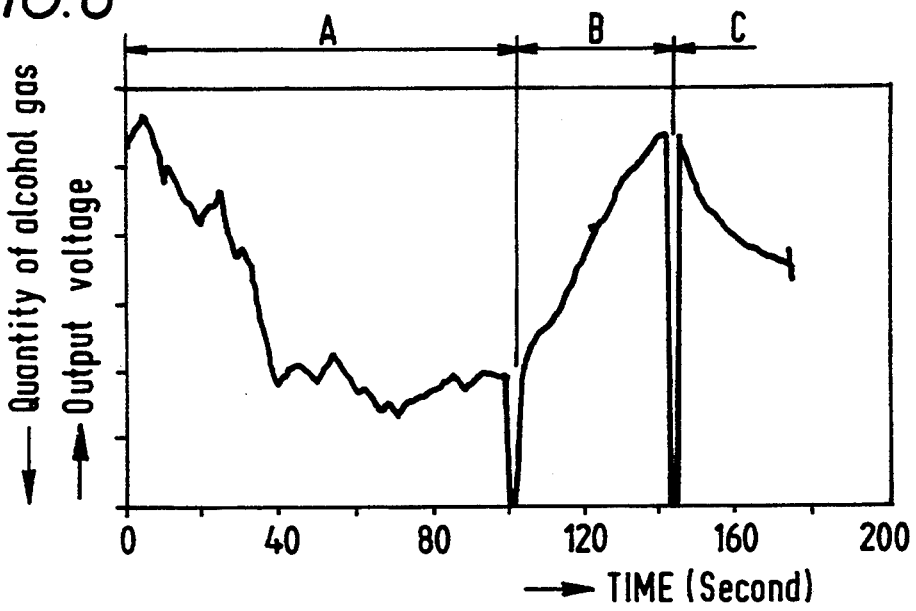
FIG. 6 is a graph showing the amount of alcohol gas in the heating cavity of the embodiment of the invention in a first situation.

FIG. 6 shows the case wherein food containing alcohol is heated during period A and the next food item heated during period C contains alcohol. During period A, the output voltage V sharply decreases in accordance with the quantity of alcohol gas generated by the food. Since the percentage change of the output voltage ΔV is larger than 0.5, a cleaning operation is performed during time period B. The output voltage V increases as the quantity of alcohol gas decreases as a result of the cleaning operation. Then, during period C, the output voltage V is high at the beginning of the next heating operation. The quantity of alcohol gas detected during period C is not affected by the previous heating operation during period A. Therefore, the heating operation during period C can be performed properly.

Figure 7:
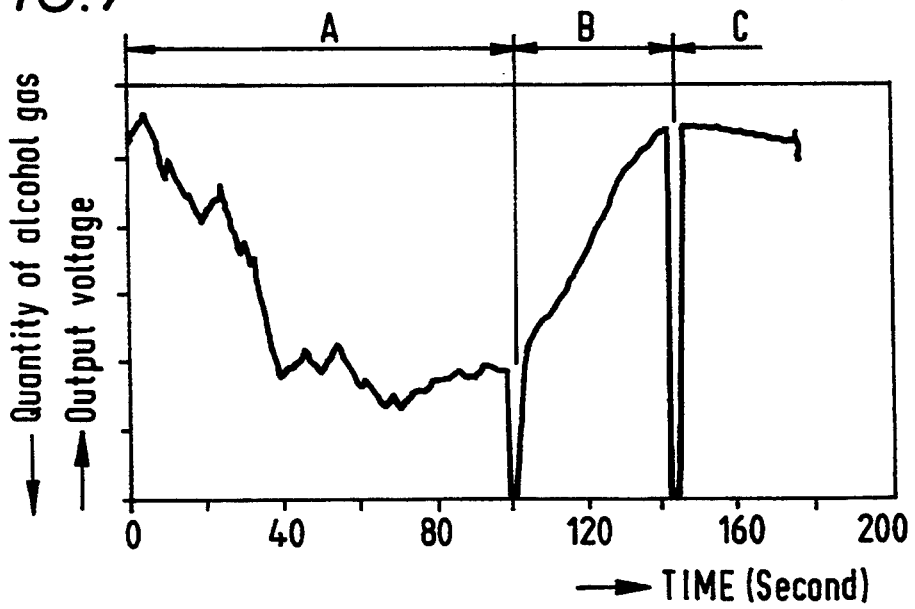
FIG. 7 is a graph showing the amount of alcohol gas in the heating cavity of the embodiment of the invention in a second situation.

FIG. 7 shows the case wherein food containing alcohol is heated during period A and the next food item heated during period C contains little alcohol. During period A, the output voltage V is similar to FIG. 6. Therefore, a cleaning operation is performed during period B. Very little alcohol gas is detected at the beginning of period C, and the output voltage V scarcely decreases during period C, because the food contains little alcohol.

Figure 8:
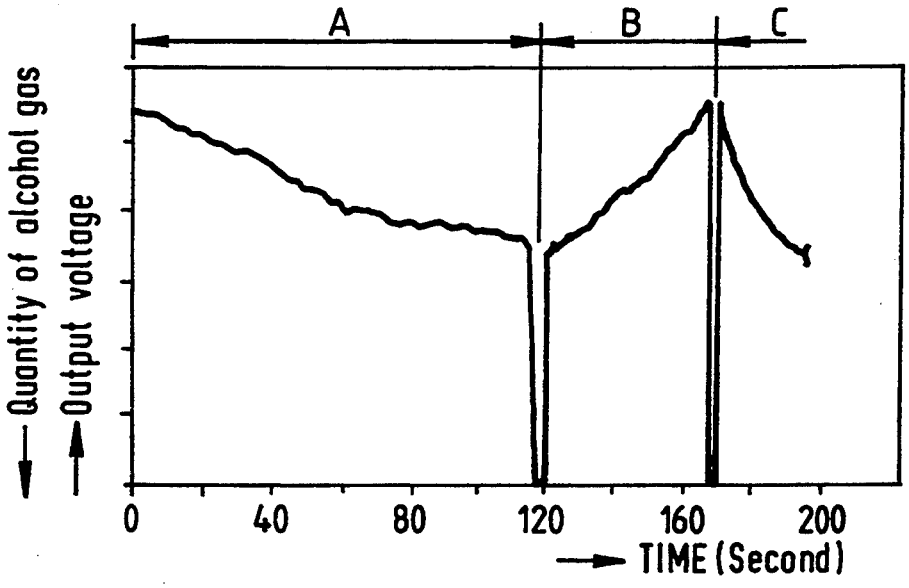
FIG. 8 is a graph showing the amount of alcohol gas in the heating cavity of the embodiment of the invention in a third situation.

FIG. 8 shows the case wherein food containing little alcohol is heated during period A and the next food item heated during period C contains alcohol. The food cooked during period A contains so little alcohol that the percentage change of the output voltage ΔV is less than 0.5. Therefore, no cleaning operation is performed during period B. A portion of the alcohol gas in the heating cavity 4 is discharged by natural ventilation during period B. Therefore, the output voltage V at the beginning of period C is high, and it decreases in accordance to the quantity of the alcohol gas generated by the next food item.

Figure 9:
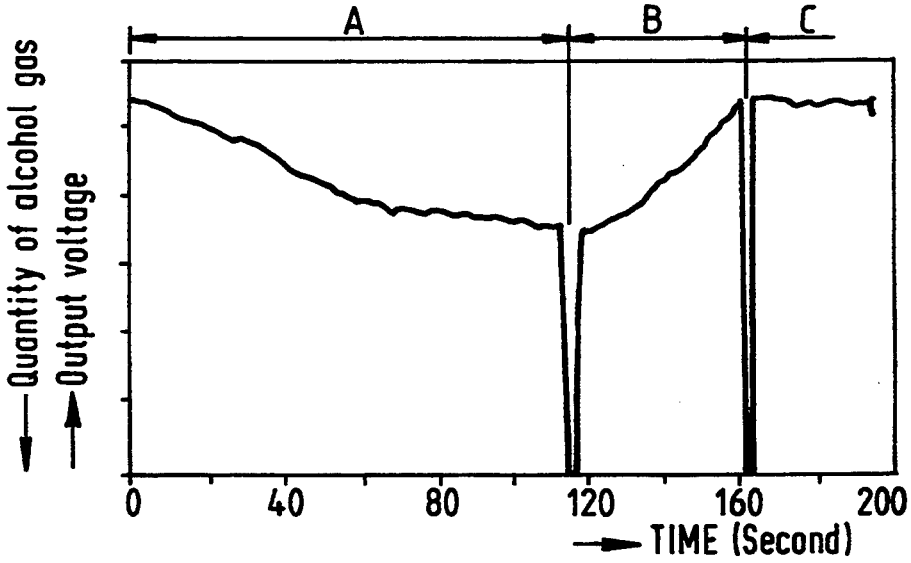
FIG. 9 is a graph showing the amount of alcohol gas in the heating cavity of the embodiment of the invention in a fourth situation.
Figure 12:
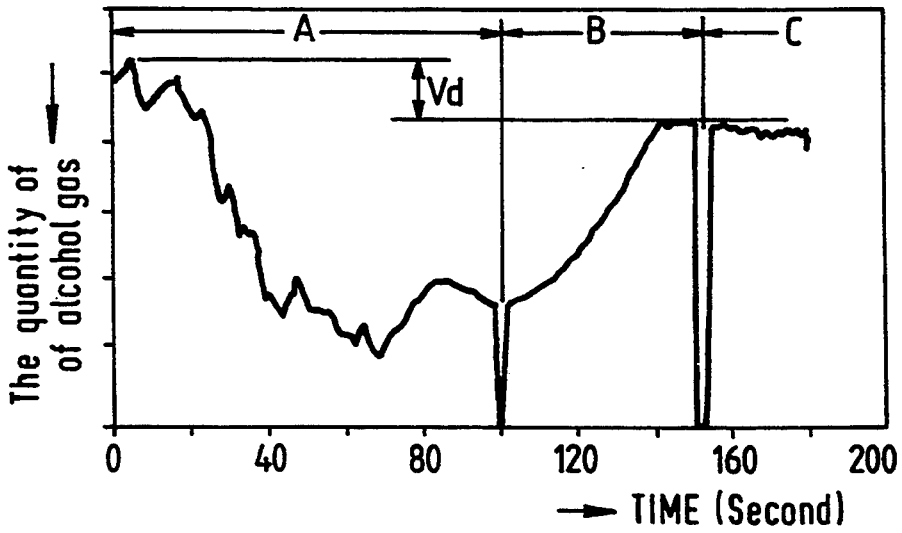
FIG. 12 is a graph showing a change of alcohol gas in the heating cavity of a prior art heating apparatus.

FIG. 9 shows the case wherein food cooked during periods A and C contain little alcohol. The food cooked during period A contains so little alcohol that the percentage change of the output voltage ΔV is less than 0.5. Therefore, no cleaning operation is performed during period B. A portion of the alcohol gas in the heating cavity 4 is discharged by natural ventilation during period B. As a result, the output voltage V is high at the beginning of period C and the output voltage V scarcely decreases during period C, because the next food item contains little alcohol.

Under these conditions, the quantity of alcohol gas detected during the next heating operation in period C is not affected by the heating operation during period A. Therefore, the heating operation during period C can be performed properly.

Figure 10:
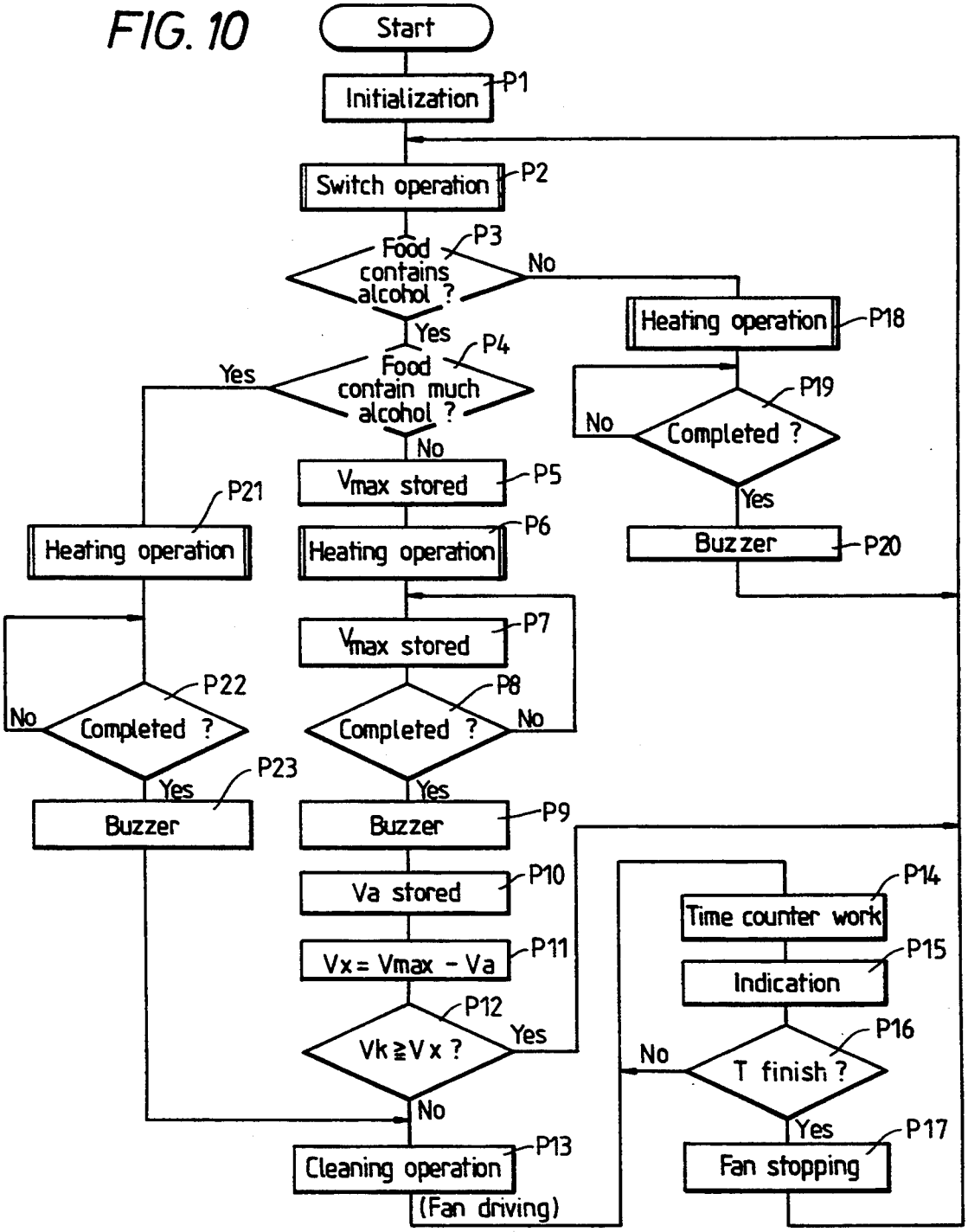
FIG. 10 is a flow chart showing a control program of the heating and cleaning operation of a second embodiment of the invention.

With reference to FIG. 10, the operation of the control circuit 20 of a second embodiment is shown as a flow-chart. In this embodiment, all the steps are the same as in FIG. 5, except the step P11 and the step P12 are different from the step S11 and the step S12. In the step P11 the amount Vx by which the output voltage V changes during the step P6 is calculated. The amount Vx is calculated as:

$$VX = Vmax - Va$$

At step P12, it is decided whether or not the amount of change Vx is larger than a reference value Vk previously stored in the control circuit. If it is larger, a cleaning operation is performed by energizing the fan 7. In this embodiment, instead of calculating the percentage change as in the previous embodiment the amount of change is determined. The same benefits can be obtained with this embodiment as with the previous embodiment.

Figure 11:
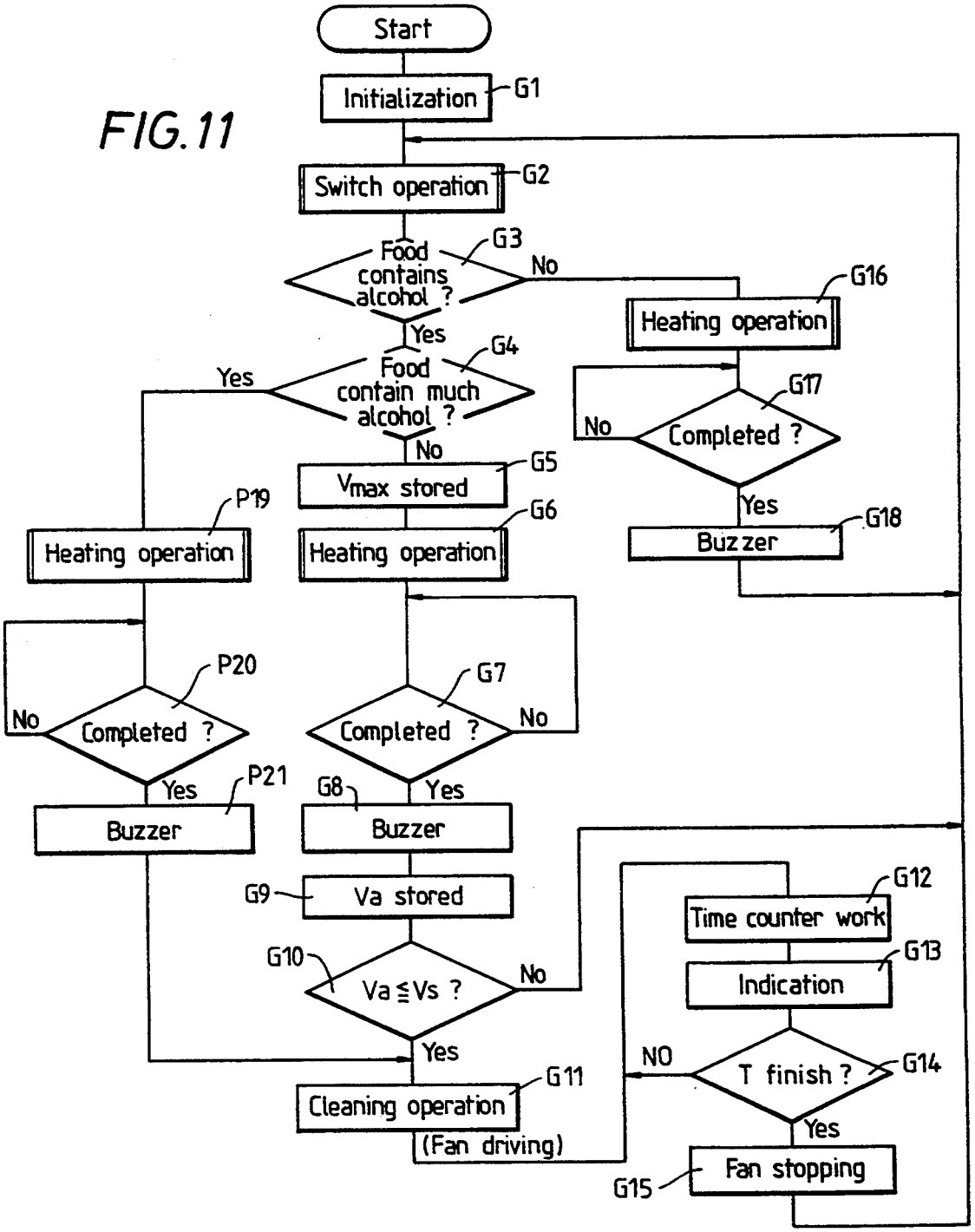
FIG. 11 is a flow chart showing a control program of the heating and cleaning operation of a third embodiment of the invention.

With reference to FIG. 11, the operation of the control circuit 20 of a third embodiment is shown as a flow-chart. The primary difference between this embodiment and the first embodiment is that the step G10 is different from steps S11 and S12 of the first embodiment. Specifically, a decision is made as to whether or not the output voltage Va at the completion of the heating operation is smaller than a reference value Vs previously stored in the control circuit 20. If it is smaller, the cleaning operation is performed by energizing the fan 7. The same benefits can be obtained with this embodiment as with the first embodiment.

In each of the embodiments mentioned above, the control data is manually set by an operator using the switches 19 in the step S2, P2 or G2. However, automatic operation can be performed, wherein the control data is automatically determined and set in accordance with the outputs from various sensors.

While the invention has been described with reference to several embodiments, it will be understood by those skilled in the art that various modifications may be made without departing from the spirit and scope of the invention as set forth in the appended claims.

What is claimed is:

1. An apparatus for heating food comprising:
   - a cavity;
   - a heating source operable to heat a food portion placed in said cavity during a heating operation;
   - an alcohol sensor for detecting alcohol gas emitted by said food portion within said cavity;
   - a fan constructed and arranged to expel gas from said cavity; and
   - control means responsive to said alcohol sensor for controlling said heating source to heat said food portion as a function of alcohol gas emitted from said food portion during said heating operation, and for controlling said fan to expel said gas from said cavity after said heating operation in accordance with said alcohol gas detected by said alcohol sensor.

2. An apparatus for heating food as claimed in claim 1 wherein said control means comprises:
   - means for calculating a percentage change in an amount of said alcohol gas within said cavity;
   - means for ascertaining whether said percentage change is larger than a reference value; and
   - means for energizing said fan when said percentage change is larger than said reference value.

3. An apparatus for heating food as claimed in claim 1 wherein said control means comprises:
   - means for calculating an amount of change of said alcohol gas within said cavity;

means for ascertaining whether said amount of change is larger than a reference value; and means for energizing said fan when said amount of change is larger than said reference value.

4. An apparatus for heating food as claimed in claim 1 wherein said control means comprises:

means for ascertaining whether an amount of said alcohol gas detected by said alcohol sensor is larger than a reference value; and means for energizing said fan when said amount of said alcohol gas is larger than said reference value.

5. An apparatus for heating food as claimed in claim 2, 3 or 4, wherein said energizing means is capable of energizing said fan independently from a signal generated by the alcohol sensor when data corresponding to a particular type of food portion is input to said control means before said heating operation.

6. An apparatus for heating food comprising:

a cavity;

a heating source operable to heat a food portion placed in said cavity during a heating operation;

an alcohol sensor for detecting alcohol gas emitted by said food portion within said cavity;

a fan constructed and arranged to expel gas from said cavity; and circuitry responsive to said alcohol sensor to control said heating source during said heating operation and to selectively drive said fan said cavity by said alcohol sensor.

7. An apparatus for heating food as claimed in claim 6 wherein said circuitry comprises:

means for calculating a percentage change in an amount of said alcohol gas within said cavity; means for ascertaining whether said percentage change is larger than a reference value; and means for energizing said fan when said percentage change is larger than said reference value.

8. An apparatus for heating food as claimed in claim 6 wherein said circuitry comprises:

means for calculating an amount of change of said alcohol gas within said cavity;

means for ascertaining whether said amount of change is larger than a reference value; and means for energizing said fan when said amount of change is larger than said reference value.

9. An apparatus for heating food as claimed in claim 6 wherein said circuitry comprises:

means for ascertaining whether an amount of said alcohol gas detected by said alcohol sensor is larger than a reference value; and means for energizing said fan when said amount is larger than said reference value.

10. An apparatus for heating food as claimed in claim 7, 8 or 9, wherein said energizing means is capable of energizing said fan independently, from an output signal generated by the alcohol sensor when data corresponding to a particular type of food portion is input to said circuitry before said heating operation.

11. A method for cooking food comprising:

heating food in a heating apparatus;

detecting alcohol gas emitted from said food;

controlling said heating to heat said food to an extent determined by the alcohol detected; and selectively expelling gas from said heating apparatus in accordance with alcohol gas detected during said detecting.

12. A method as in claim 11, wherein said expelling is conducted in accordance with an amount of alcohol gas detected.

13. A method as in claim 11, wherein said expelling expels gas in accordance with a percentage change in an amount of alcohol gas detected.

14. A method as in claim 11, wherein the amount of gas expelled during said expelling expels gas in accordance with an amount by which the alcohol gas changes during said heating.

15. A method as in claim 11, wherein said expelling expels gas in accordance with an amount of alcohol gas detected during said detecting is more than a predetermined amount.

16. A method for cooking food comprising:

heating a food portion placed in a heating apparatus during a heating operation;

detecting alcohol gas emitted from said food portion during said heating operation;

controlling said heating apparatus to heat said food portion to an extent determined by alcohol detected during said detecting;

terminating said heating operation; and expelling alcohol gas from said cavity after said heating operation in accordance with alcohol gas contained within said cavity.

17. The method according to claim 16, further comprising:

terminating said expelling, and then commencing another heating operation in which another food portion is heated.

* * * * *